US011028731B2

(12) United States Patent
Hori et al.

(10) Patent No.: US 11,028,731 B2
(45) Date of Patent: Jun. 8, 2021

(54) CASING POSITION ADJUSTMENT DEVICE

(71) Applicant: Mitsubishi Hitachi Power Systems, Ltd., Kanagawa (JP)

(72) Inventors: Takumi Hori, Tokyo (JP); Hidekazu Uehara, Tokyo (JP); Kentarou Saeki, Tokyo (JP); Katsuhisa Hamada, Kanagawa (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 200 days.

(21) Appl. No.: 16/089,049

(22) PCT Filed: Feb. 28, 2017

(86) PCT No.: PCT/JP2017/008017
§ 371 (c)(1),
(2) Date: Sep. 27, 2018

(87) PCT Pub. No.: WO2017/169483
PCT Pub. Date: Oct. 5, 2017

(65) Prior Publication Data

US 2019/0093514 A1 Mar. 28, 2019

(30) Foreign Application Priority Data

Mar. 31, 2016 (JP) ..... JP2016-071873

(51) Int. Cl.
*F01D 25/28* (2006.01)
*F01D 25/26* (2006.01)
(Continued)

(52) U.S. Cl.
CPC ..... *F01D 25/26* (2013.01); *F01D 19/00* (2013.01); *F01D 25/00* (2013.01); *F01D 25/162* (2013.01);
(Continued)

(58) Field of Classification Search
CPC ..... F01D 25/26; F01D 19/00; F01D 25/00; F01D 25/162; F01D 25/24; F01D 25/14;
(Continued)

(56) References Cited

U.S. PATENT DOCUMENTS 2,591,399 A 4/1952 Buckland et al.
2,632,997 A 3/1953 Howard et al.
(Continued)

FOREIGN PATENT DOCUMENTS

DE 695 08 137 9/1999
EP 1 710 399 10/2006
(Continued)

OTHER PUBLICATIONS

International Search report dated Apr. 25, 2017 in International (PCT) Application No. PCT/JP2017/008017, with English-language translation.
(Continued)

*Primary Examiner* — David E Sosnowski
*Assistant Examiner* — Sabbir Hasan
(74) *Attorney, Agent, or Firm* — Wenderoth, Lind & Ponack, L.L.P.

(57) ABSTRACT

In a steam turbine including a rotor including a free side end fixed by a journal bearing in a radial direction and a fixed side end fixed by a thrust bearing in an axial direction, and a casing including a fixed side end fixed by the thrust bearing in the axial direction, a casing position adjustment device is configured to adjust an axial position of the casing with respect to the rotor due to thermal expansion. The casing position adjustment device includes: a low-pressure casing end plate, which is an end plate oriented to a free side in the axial direction in a low-pressure casing of the casing, and has a diaphragm deformable in the axial direction; and actuators, which are configured to deform the low-pressure
(Continued)

casing end plate so that the low-pressure casing end plate extends toward the free side in the axial direction.

20 Claims, 9 Drawing Sheets

(51) Int. Cl.

| | |
|---|---|
| ***F01D 25/00*** | (2006.01) |
| ***F01D 25/24*** | (2006.01) |
| ***F01D 19/00*** | (2006.01) |
| ***F01D 25/16*** | (2006.01) |

(52) U.S. Cl.
CPC ..... *F01D 25/24* (2013.01); *F01D 25/28* (2013.01); *F05D 2220/31* (2013.01); *F05D 2240/14* (2013.01); *F05D 2270/20* (2013.01); *F05D 2270/303* (2013.01); *F05D 2270/334* (2013.01); *F05D 2270/335* (2013.01); *F05D 2270/42* (2013.01)

(58) Field of Classification Search
CPC .. F01D 25/28; F05D 2240/31; F05D 2240/14; F05D 2270/20; F05D 2270/303; F05D 2270/334; F05D 2270/335; F05D 2270/42
See application file for complete search history.

(56) References Cited

U.S. PATENT DOCUMENTS

| | | | | |
|---|---|---|---|---|
| 2,650,753 | A | 9/1953 | Howard et al. | |
| 4,102,598 | A | 6/1978 | Stock et al. | |
| 5,780,932 | A | 7/1998 | Laffont | |
| 9,334,757 | B2 | 5/2016 | Maruyama et al. | |
| 9,441,500 | B2 * | 9/2016 | Hori ..... | F01D 11/20 |
| 9,488,062 | B2 * | 11/2016 | Black ..... | F01D 11/22 |
| 2011/0318162 | A1 | 12/2011 | Cottrell et al. | |
| 2013/0216354 | A1 | 8/2013 | Maruyarria et al. | |

FOREIGN PATENT DOCUMENTS

| | | |
|---|---|---|
| GB | 995473 | 5/1962 |
| GB | 998519 | 7/1965 |
| JP | 52-60313 | 5/1977 |
| JP | 4-132805 | 5/1992 |
| JP | 2013-170468 | 9/2013 |
| JP | 2013-234664 | 11/2013 |
| WO | 2013/121603 | 8/2013 |

OTHER PUBLICATIONS

Office Action dated May 21, 2020 in corresponding India Patent Application No. 201817035545.
Office Action dated Oct. 18, 2020 in German Patent Application No. 11 2017 001 730.0 with English translation.

* cited by examiner

CASING POSITION ADJUSTMENT DEVICE

TECHNICAL FIELD

The present invention relates to a casing position adjustment device for a steam turbine to be used in, for example, a power plant.

BACKGROUND ART

A steam turbine is used to supply motive power to a generator in, for example, a power plant. A rotor provided to the steam turbine is fixed in a radial direction by a journal bearing on a front side of a casing, and is fixed in an axial direction by a thrust bearing on a rear side of the casing.

In the steam turbine, the rotor and a turbine casing (inner casing) are increased in length from the thrust bearing in the rotor axial direction due to a phenomenon called "thermal expansion". A displacement amount caused by the thermal expansion is larger on the rotor side than on the inner casing side. Herein, a difference between the displacement amount caused by the thermal expansion on the rotor side and that on the inner casing side is referred to as "thermal expansion difference". The thermal expansion difference degrades turbine efficiency.

CITATION LIST

Patent Document

Patent Document 1: JP 2013-234664 A
Patent Document 2: JP 2013-170468 A

SUMMARY OF INVENTION

Problem to be Solved by the Invention

For example, an ACC abradable seal is provided to an inner peripheral surface of a high-pressure turbine dummy portion in the casing. Seal dams protruding to the rotor side are formed on the ACC abradable seal at a predetermined interval in the rotor axial direction. Further, seal fins protruding to the casing side are formed on the rotor at a predetermined interval in the rotor axial direction. Further, the seal dams formed on the ACC abradable seal and the seal fins formed on the rotor are formed apart from one another in the rotor axial direction.

However, when the thermal expansion difference is caused, the seal fins and the seal dams are displaced relative to one another, with the result that the seal fins may be brought into contact with the seal dams. Therefore, it is required that a large clearance be designed in advance in consideration of the thermal expansion difference. However, with the clearance, a leakage amount is increased at the portion, and hence the turbine efficiency is degraded.

Further, when the thermal expansion difference is caused, there is a risk in that the seal fins may be disengaged from the seal dams. Through the disengagement, a leakage amount between the seal dams and the seal fins is increased, and the efficiency of the steam turbine is degraded.

Meanwhile, a shaft seal (such as a labyrinth seal) is provided to an inner peripheral surface of a high-pressure turbine cascade portion in the casing. The shaft seal has a surface, which is opposed to the rotor and formed so as to be close to the rotor side in a stepwise manner as approaching to the thrust bearing. Further, a seal fin protruding to the rotor side is formed on each step of the surface. Further, a rotor blade provided to the rotor has a surface, which is opposed to the casing and formed so as to be close to the casing side in a stepwise manner as approaching to the thrust bearing. Further, the seal fins of the shaft seal are arranged at optimum positions correspondingly to the steps of the rotor blade.

However, when the thermal expansion difference is caused, the seal fins of the shaft seal are displaced from the optimum positions, with the result that the seal fins may be disengaged from the steps of the rotor blade. Through the disengagement, a leakage amount between the seal fins and the rotor blade is increased, and the turbine efficiency is degraded.

In order to solve the above-mentioned problems, as an existing technology, there is a method of adjusting positions of the casing and the rotor by an actuator according to the thermal expansion difference.

In a case in which the thermal expansion difference is adjusted through passive control on the rotor side, there is a method of, for example, employing a shaft joint (for example, a gear coupling or a joint made of a material having a small linear expansion coefficient), which is capable of absorbing thermal expansion of the rotor. Accordingly, the thermal expansion difference is reduced. However, with this method, a sensory feedback is not performed. Thus, there is a problem in that the thermal expansion difference cannot be controlled within a target value range with high accuracy.

In a case in which the thermal expansion difference is adjusted through active control on the rotor side, there is a method of, for example, pressing a bearing pad by a positioning mechanism (actuator) from a rear surface of the thrust bearing. Accordingly, the thermal expansion difference is adjusted. However, with this method, the actuator is required to be incorporated in the casing similarly to the thrust bearing and other components. Thus, a prompt action cannot be taken in case of trouble. Moreover, there is a problem in that it is difficult to apply the method to an existing steam turbine.

In a case in which the thermal expansion difference is adjusted through passive control on the casing side, there is a method of, for example, allowing a thermal expansion of a tie beam so that the inner casing coupled to a base is also thermally expanded. Accordingly, a thermal expansion amount of the inner casing and a thermal expansion amount of the rotor is equal to each other, and hence the thermal expansion difference is reduced. However, with this method, a sensor feedback is not performed. Thus, there is a problem in that the thermal expansion difference cannot be controlled within a target value range with high accuracy.

Therefore, it is desired that the thermal expansion difference be adjusted through active control on the casing side. As such a method, as described in, for example, Patent Document 1 described above, the thermal expansion difference is measured, and the entire inner casing is actively moved by a hydraulic or pneumatic actuator. Accordingly, the thermal expansion difference is reduced.

However, a thrust load generated during a normal operation or an earthquake is excessively large. Thus, with the method described in Patent Document 1 described above, the actuator or a reaction force receiver is required to be increased in size when the thrust load is supported by the actuator. Accordingly, there is a problem in that it is difficult to secure an installation space. Further, there is a risk of a blade contact when the thrust force of the actuator is lost.

Therefore, in view of the above-mentioned technical problems, the present invention has an object to provide a casing position adjustment device, in which a thrust load is received by anchor bolts and a thermal expansion difference is canceled so that turbine efficiency can be improved.

Solution to Problem

In order to achieve the above-mentioned object, there is provided a casing position adjustment device according to a first invention. In a steam turbine including a rotor including a free side end fixed by a journal bearing in a radial direction and a fixed side end fixed by a thrust bearing in an axial direction, and a casing including a fixed side end fixed by the thrust bearing in the axial direction, the casing position adjustment device is configured to adjust an axial position of the casing with respect to the rotor due to thermal expansion. The casing position adjustment device includes: a low-pressure casing end plate, which is an end plate oriented to a free side in the axial direction in a low-pressure casing of the casing, and has a diaphragm shape deformable in the axial direction; and actuators, which deform the low-pressure casing end plate such that the low-pressure casing end plate extends toward the free side in the axial direction.

In order to achieve the above-mentioned object, the casing position adjustment device according to the first invention includes a casing position adjustment device according to a second invention. The casing is fixed by anchor bolts on the fixed side in the axial direction with respect to the low-pressure casing end plate.

In order to achieve the above-mentioned object, the casing position adjustment device according to the first invention or the second invention includes a casing position adjustment device according to a third invention. The actuators are respectively connected to both ends of the lower-pressure casing end plate in the radial direction and a horizontal direction from the free side in the axial direction.

In order to achieve the above-mentioned object, the casing position adjustment device according to the first invention or the second invention includes a casing position adjustment device according to a fourth invention. The journal bearing is fixed to the casing having arms respectively extending from both sides in the radial direction and the horizontal direction. The actuators are respectively connected to the arms from the fixed side in the axial direction.

In order to achieve the above-mentioned object, the casing position adjustment device according to the first invention or the second invention includes a casing position adjustment device according to a fifth invention, which further includes: a first sensor for measuring a thermal expansion difference being a difference of a displacement amount of the rotor and a displacement amount of the casing due to thermal expansion; and a controller for controlling the actuators based on a measured value obtained by the first sensor.

In order to achieve the above-mentioned object, the casing position adjustment device according to the fifth invention includes a casing position adjustment device according to a sixth invention, which further includes a second sensor for measuring thrust force of the actuators. The controller controls the actuators such that a measured value obtained by the second sensor becomes equal to or less than a first predetermined value.

In order to achieve the above-mentioned object, the casing position adjustment device according to the fifth invention includes a casing position adjustment device according to a seventh invention, which further includes a third sensor for measuring a distortion force of the low-pressure casing end plate. The controller controls the actuators such that a measured value obtained by the third sensor becomes equal to or less than a second predetermined value.

In order to achieve the above-mentioned object, the casing position adjustment device according to any one of the fifth invention includes a casing position adjustment device according to an eighth invention, which further includes a fourth sensor for measuring vibration of the low-pressure casing end plate. The controller controls the actuators such that a measured value obtained by the fourth sensor becomes equal to or less than a third predetermined value.

In order to achieve the above-mentioned object, the casing position adjustment device according to any one of the fifth invention includes a casing position adjustment device according to a ninth invention, which further includes a fifth sensor for measuring rotation torque of the rotor. The controller controls the actuators such that, based on a measured value obtained by the fifth sensor, a relative position between the casing and the rotor in the axial direction becomes a position enabling a maximum output of the steam turbine.

In order to achieve the above-mentioned object, the casing position adjustment device according to the fifth invention includes a casing position adjustment device according to a tenth invention, which further includes a sixth sensor for measuring temperature in the casing. The controller controls the actuators such that, based on a measured value obtained by the sixth sensor, a relative position between the casing and the rotor in the axial direction becomes a position enabling a maximum output of the steam turbine.

In order to achieve the above-mentioned object, the casing position adjustment device according to the third invention includes a casing position adjustment device according to an eleventh invention. The casing is fixed on the base through intermediation of a base plate. Reaction force receivers are respectively arranged to both ends of the low-pressure casing end plate in the radial direction and the horizontal direction on the base on the free side. Lower parts of the reaction force receivers extend toward the base plate, and are fixed. The actuators are interposed between the reaction force receivers and the low-pressure casing end plate.

In order to achieve the above-mentioned object, the casing position adjustment device according to the third invention includes a casing position adjustment device according to a twelfth invention. The reaction force receivers are respectively fixed to both ends of the low-pressure casing end plate in the radial direction and the horizontal direction on the base on the free side. The actuators are interposed between the reaction force receivers and the low-pressure casing end plate.

In order to achieve the above-mentioned object, the casing position adjustment device according to the fourth invention includes a casing position adjustment device according to a thirteenth invention. Reaction force receivers are respectively fixed to fixed sides of the arms on the base. The actuators are interposed between the reaction force receivers and the arms.

In order to achieve the above-mentioned object, the casing position adjustment device according to the first invention includes a casing position adjustment device according to a fourteenth invention. The actuators are arranged in an outermost diameter of the low-pressure casing end plate in the radial direction.

In order to achieve the above-mentioned object, the casing position adjustment device according to the first invention includes a casing position adjustment device according to a fifteenth invention. The low-pressure casing end plate is expanded in a substantially semi-circular shape in the radial direction, and has a shape in which a periphery of a radial outer circumference is inclined in the axial direction.

Advantageous Effect of Invention

With the casing position adjustment device according to the present invention, the thrust load is received by the anchor bolts, and the thermal expansion difference is canceled. Accordingly, the turbine efficiency can be improved.

BRIEF DESCRIPTION OF DRAWINGS

FIG. 2A is a cross-sectional view taken along line a-a of FIG. 1, and FIG. 2B is a perspective view of the casing.

FIG. 3A is a partial top view. FIG. 3B is a side view. FIG. 3C is a partial front view.

FIG. 4A is a top view. FIG. 4B is a side view. FIG. 4C is a partially enlarged view of a portion surrounded by the dashed line of FIG. 4B.

FIG. 5A is a view of a state before deformation, and FIG. 5B is a view of a state after deformation.

FIG. 8A is a top view. FIG. 8B is a side view. FIG. 8C is a partially enlarged view of a portion surrounded by the dashed line of FIG. 8B.

DESCRIPTION OF EMBODIMENTS

Now, detail description is made of a casing position adjustment device according to embodiments of the present invention with reference to the drawings.

First Embodiment

Figure 1:
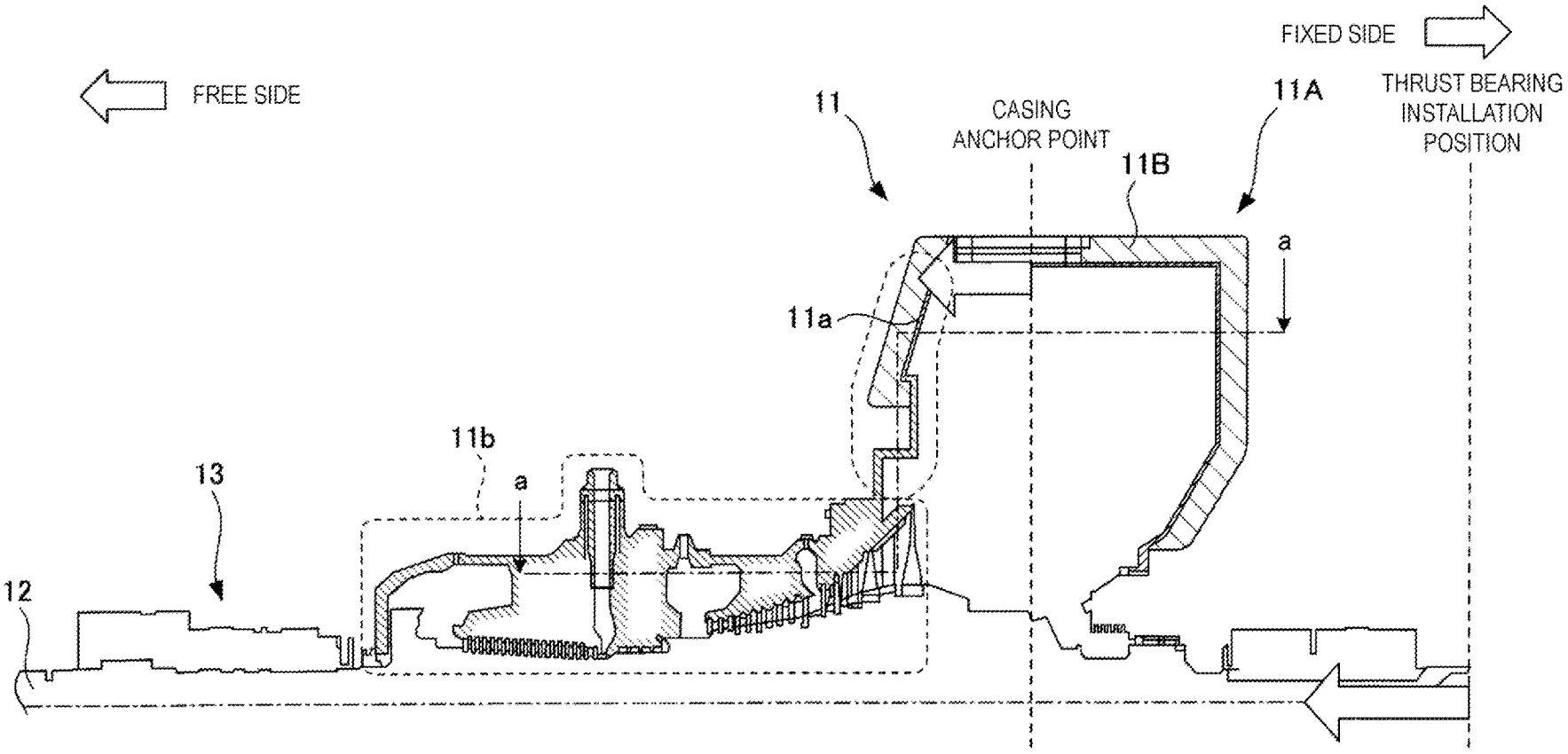
FIG. 1 is a cross-sectional view of a casing and a periphery of the casing of a steam turbine in a first embodiment of the present invention.

FIG. 1 is a schematic cross-sectional view of a casing and a periphery of the casing of a steam turbine. A left side of the drawing sheet is a free side, and a right side of the drawing sheet is a fixed side. In FIG. 1, a journal bearing for supporting a free side of a rotor 12 and a thrust bearing for supporting a fixed side of the rotor 12 are omitted. However, an axial position of "thrust bearing installation position" is indicated by the dashed line. Further, the white solid arrow having a starting point from the dashed line indicating the thrust bearing installation position indicates that the rotor 12 is thermally expanded from the starting point. The orientation of the arrow indicates the direction of the thermal expansion of the rotor 12.

The casing position adjustment device according to this embodiment is configured to perform positioning control on the casing side in the axial direction. Further, in this embodiment, unlike Patent Document 1 described above, an entire casing 11 is not set in a completely free state. Instead, the casing 11 is fixed by anchor bolts at an axial position of "casing anchor point" indicated by the dashed line in FIG. 1. Note that, the white solid arrow extending from the dashed line of the casing anchor point indicates the thermal expansion of the casing 11. Further, the white solid arrow having a starting point from the dashed line of the casing anchor point indicates that the casing 11 is thermally expanded from the starting point. The orientation of the arrow indicates a direction of the thermal expansion of the casing 11.

Further, a plate (low-pressure casing end plate) 11*a* (indicated by the dashed line frame) on an end surface of a low-pressure casing 11A, which is oriented to the free side in the axial direction, has a flexible structure in a diaphragm shape. On an outer surface of the low-pressure casing 11A, a rib 11B is provided. Specifically, a strength design is provided in the following manner: the low-pressure casing end plate 11*a* capable of suppressing influence of pressure deformation is reduced in thickness to enable deformation of a thermal expansion difference adjustment margin of ±2 mm by a portion reduced in thickness. Further, the low-pressure casing end plate 11*a* is deformed by an actuator. Note that, the low-pressure casing end plate 11*a* is expanded in a substantially semi-circular shape in a radial direction and has a shape in which a periphery of a radial outer circumference is inclined in the axial direction as illustrated in FIG. 1.

That is, a thrust load is received by the anchor bolts, and a part of the casing 11 (the low-pressure casing end plate 11*a*) is deformed into a diaphragm shape so that a blade ring inside is subjected to positioning adjustment.

Even when the casing 11 is set in a completely free state, it is required that all the thrust loads applied to the casing 11 (loads generated due to a pressure difference, thermal expansion, earthquake acceleration, or other factors) be supported by the actuator. Thus, there arise problems such as a blade contact due to, for example, the thrust force loss of the actuator and increase in size of the actuator. Therefore, in this embodiment, the thrust load is received by the anchor bolts, and the part of the casing 11 (the low-pressure casing end plate 11*a*) is deformed into a diaphragm shape, to thereby perform positioning adjustment. In this manner, fail-safe in an emergency is enabled, and the actuator can be reduced in size.

Figure 2A:
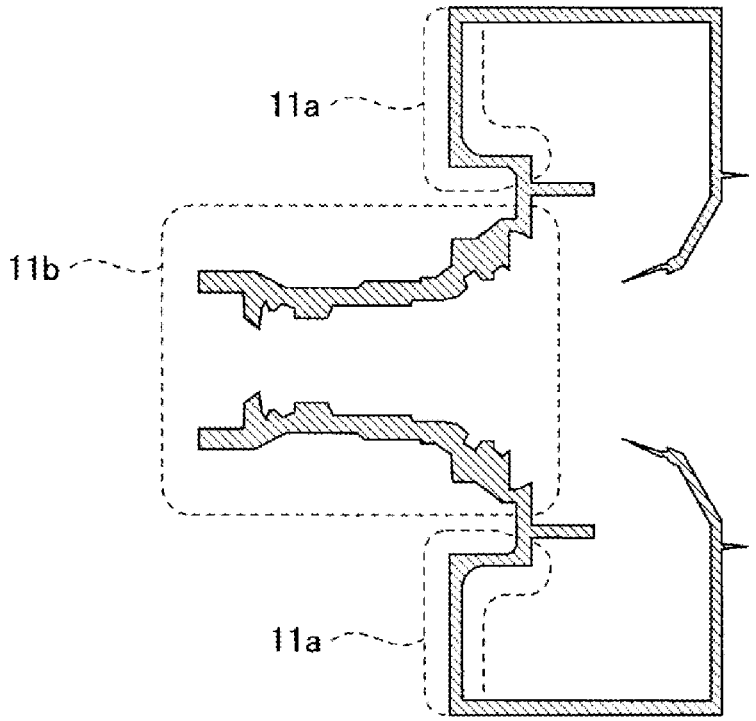
FIGS. 2A and 2B are views for illustrating an example of a shape of the casing including a diaphragm portion.
Figure 2B:
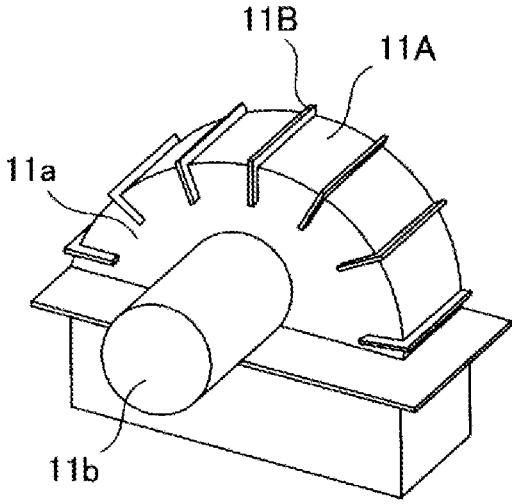

FIGS. 2A and 2B are views for illustrating an example of a shape of the casing including a diaphragm portion. FIG. 2A is a cross-sectional view taken along line a-a of FIG. 1, and FIG. 2B is a perspective view of the casing.

The low-pressure casing end plate 11*a* having a diaphragm shape is deflected when a rigid portion (high-pressure casing) 11*b* is moved and adjusted to the free side in the axial direction. In this manner, only the rigid portion (high-pressure casing) 11*b* is moved and adjusted by ±2 mm while the casing 11 is fixed by the anchor.

Figure 3A:
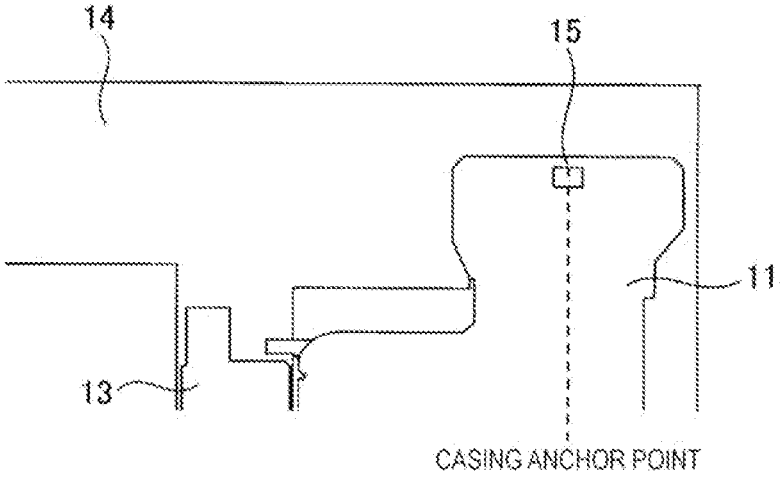
FIGS. 3A to 3C are schematic views of the casing and the periphery of the casing of the steam turbine in the first embodiment of the present invention.
Figure 3B:
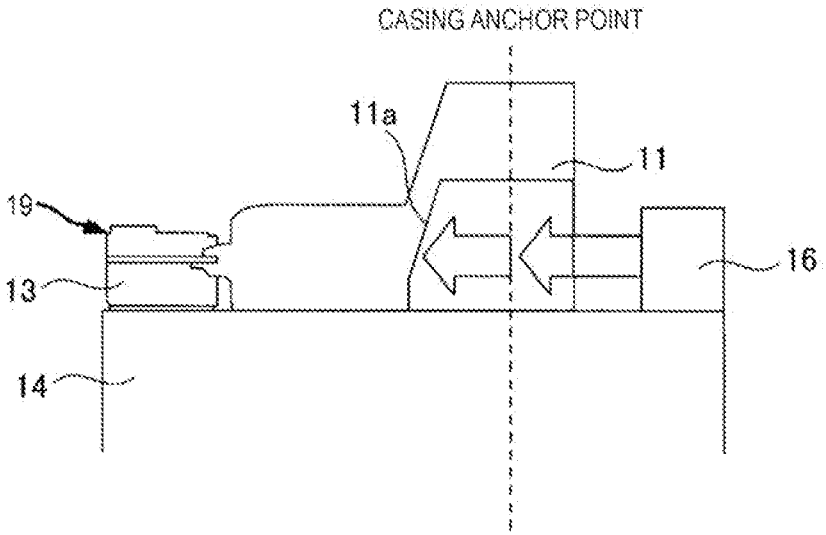
Figure 3C:
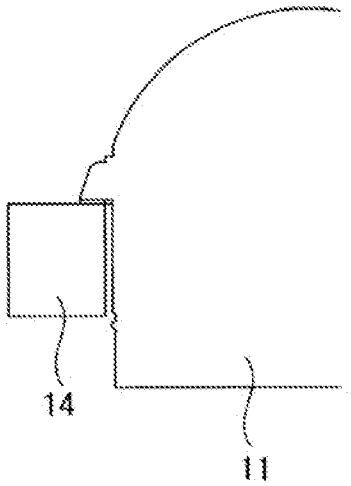

FIGS. 3A to 3C are schematic views of the casing 11 and the periphery of the casing 11 of the steam turbine. FIG. 3A is a partial top view. FIG. 3B is a side view. FIG. 3C is a partial front view. Further, in FIG. 3B, a thrust bearing 16 is illustrated. Further, in FIGS. 3A and 3B, the dashed line indicating the axial position of the casing anchor point is illustrated. Similarly to FIG. 1, the white solid arrow has the starting point from the dashed line. Further, similarly to the white solid arrow having the starting point from the thrust bearing installation position in FIG. 1, the white solid arrow has a starting point from the thrust bearing 16.

As illustrated in FIGS. 3A, 3B, and 3C, the casing 11, a bearing housing 13 of the journal bearing 19, and the thrust bearing 16 are placed on a base 14. As illustrated in FIG. 3A, the casing 11 is fixed to the base 14 at both ends in the rotor radial direction and a horizontal direction of the casing 11 by anchor bolts 15 arranged on the fixed side in the rotor axial direction with respect to the low-pressure casing end plate 11*a*. As indicated by the white solid arrow in FIG. 3B, the casing 11 is thermally expanded from the anchor bolts 15 in the rotor axial direction.

The bearing housing 13 is fixed to the casing 11 by a rod (not illustrated). Further, the rotor 12 is movable with respect to the bearing housing 13 in the rotor axial direction. Therefore, the bearing housing 13 is moved in the rotor axial direction due to the thermal expansion of the casing 11. Note that, as indicated by the white solid arrow, the rotor 12 (omitted in FIG. 3) is thermally expanded from the thrust bearing 16 to the free side.

Figure 4A:
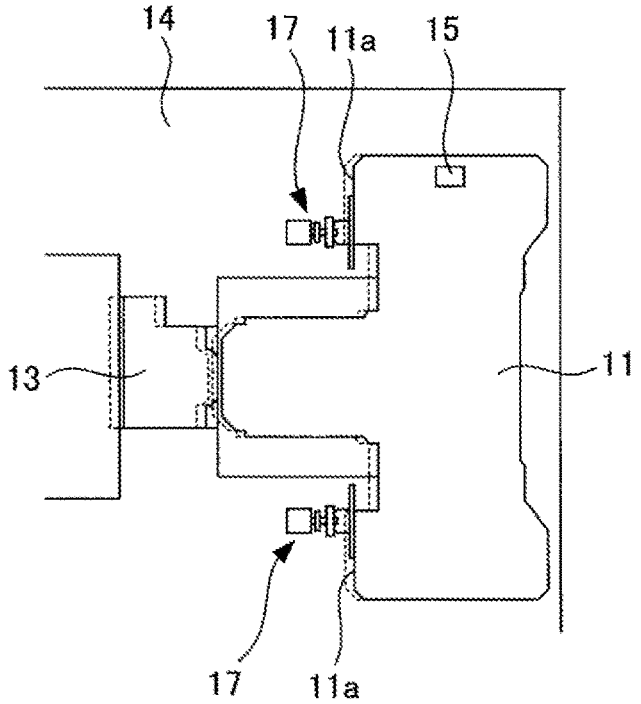
FIGS. 4A to 4C are schematic views for illustrating installation positions of actuators in the first embodiment of the present invention.
Figure 4B:
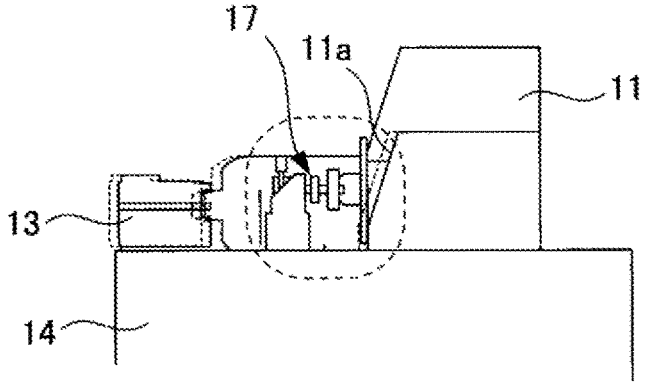
Figure 4C:
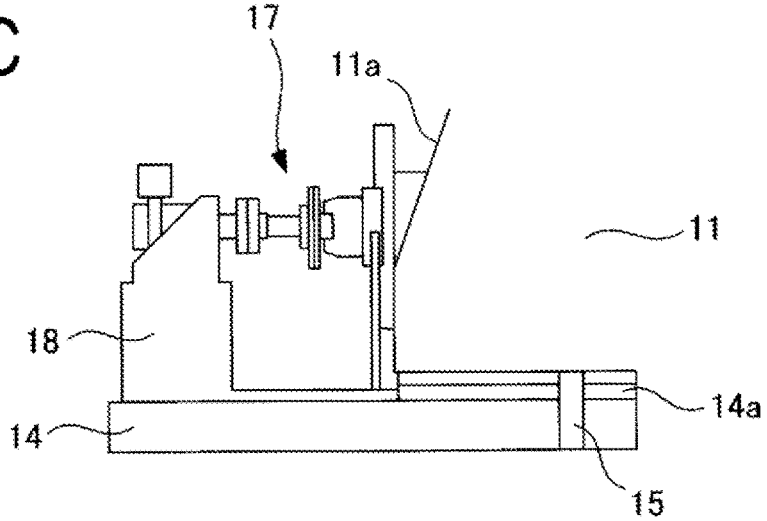

FIGS. 4A to 4C are schematic views for illustrating installation positions of actuators 17 in this embodiment. FIG. 4A is a top view. FIG. 4B is a side view. FIG. 4C is a partially enlarged view of a portion surrounded by the dashed line of FIG. 4B. Note that, in FIGS. 4A and 4B, illustration of the thrust bearing is omitted.

As illustrated in FIG. 4C, the anchor bolts 15 are arranged to pass through the casing 11, a base plate 14*a*, and the base 14. In this manner, the casing 11 is fixed to the base 14 through intermediation of the base plate 14*a*.

Further, reaction force receivers 18 are respectively arranged to both ends of the low-pressure casing end plate 11*a* in the rotor radial direction and the horizontal direction on the base 14 on the free side. Further, lower parts of the reaction force receivers 18 extend toward the base plate 14*a*, and the extending parts of the reaction force receivers 18 and the base plate 14*a* are fixed to each other by welding, a bolt, or the like. Further, the actuators 17 are interposed and fixed between the reaction force receivers 18 and the low-pressure casing end plate 11*a*. That is, the actuators 17 are respectively connected to both the ends of the low-pressure casing end plate 11*a* in the rotor radial direction and the horizontal direction.

In the casing position adjustment device according to this embodiment, when the thermal expansion difference is caused, the actuators 17 pull the low-pressure casing end plate 11*a* toward the free side (thermal expansion direction). With this action, as indicated by the dashed lines in FIGS. 4A and 4B, the low-pressure casing end plate 11*a* is deformed to extend in the rotor thermal expansion direction (to the free side in the rotor radial direction). Then, the casing 11 and the bearing housing 13 fixed to the casing 11 are displaced in the thermal expansion direction of the rotor (to the free side in the rotor radial direction). Thus, the thermal expansion difference can be canceled.

Reaction forces generated when the actuators 17 pull the low-pressure casing end plate 11*a* are received by the anchor bolts 15. Further, for example, a pressure type is employed for the actuators 17. Particularly, for example, it is preferred to employ a hydraulic jack to be used also for replacing work for heavy load of several hundred tons such as in-furnace structures.

Specifically, in the steam turbine including the rotor 12 and the casing 11, the casing position adjustment device according to this embodiment is configured to adjust axial position of the casing 11 that is thermally expanded with respect to the rotor 12. The rotor 12 includes a free side end fixed by the journal bearing 19 in the radial direction and a fixed side end fixed by the thrust bearing 16 in the axial direction. The casing 11 includes a fixed side end fixed by the thrust bearing 16 in the axial direction (rotor axial direction). The casing position adjustment device includes the low-pressure casing end plate 11*a* and the actuators 17. The low-pressure casing end plate 11*a* is an end plate oriented to the free side in the axial direction in the low-pressure casing of the casing 11, and has a deformable diaphragm shape. The actuators 17 deform the low-pressure casing end plate 11*a* so that the low-pressure casing end plate 11*a* extends toward the free side in the axial direction.

Further, the casing 11 is fixed by the anchor bolts 15 on the fixed side in the axial direction with respect to the low-pressure casing end plate 11*a*. Further, the actuators 17 are respectively connected to both the ends of the low-pressure casing end plate 11*a* in the radial direction and the horizontal direction from the free side in the axial direction.

Further, the casing 11 is fixed on the base 14 through intermediation of the base plate 14*a*. The reaction force receivers 18 are respectively arranged to both the ends of the low-pressure casing end plate 11*a* in the radial direction and the horizontal direction on the base 14 on the free side. The lower parts of the reaction force receivers 18 extend toward the base plate 14*a*, and are fixed. The actuators 17 are interposed between the reaction force receivers 18 and the rib 11*a*.

Figure 5A:
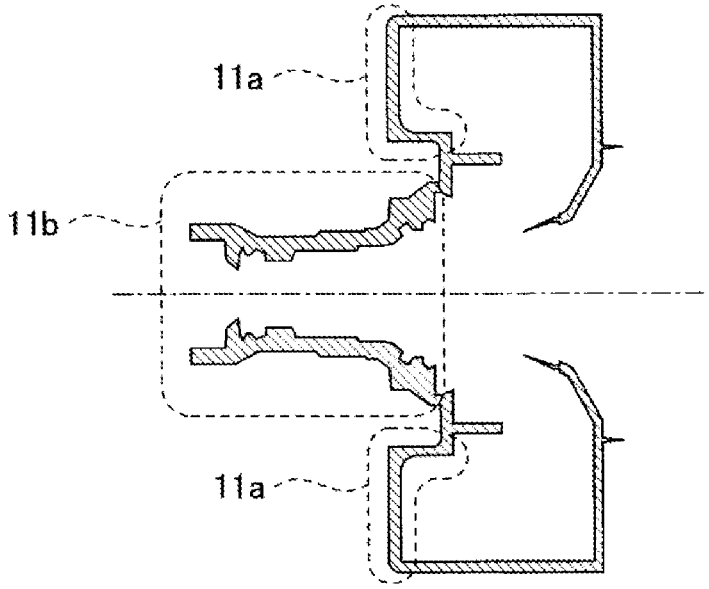
FIGS. 5A and 5B correspond to FIG. 2A, and are views for illustrating an example of pulling positions of the actuators and a result of a deformation analysis by the FEM.
Figure 5B:
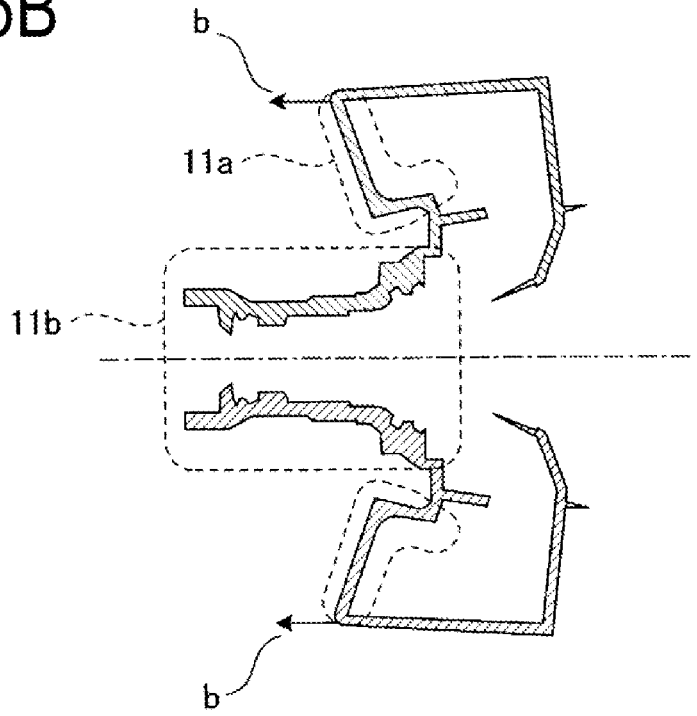

FIGS. 5A and 5B correspond to FIG. 2A, and are views for illustrating an example of pulling positions of the actuators and a result of a deformation analysis by the FEM. FIG. 5A is a view of a state before deformation, and FIG. 5B is a view of a state after deformation.

When the low-pressure casing end plate 11*a* is pulled at actuator pulling positions (outermost diameter positions of the low-pressure casing end plate 11*a*) b illustrated in FIG. 5B, that is, under the worst condition, the low-pressure casing end plate 11*a* is deformed the most, maximum stress is increased, and a moving amount of the end of the rigid portion (high-pressure casing) 11*b* on the free side is maximum. As a result of the analysis under the condition, stress of the low-pressure casing end plate 11*a* is maximum at a welding portion, which is 151.9 MPa, and satisfies allowable stress equal to or less than 199.9 MPa (1.5 σa). The end of the rigid portion (high-pressure casing) 11*b* on the free side is moved by 2.2 mm under the minimum condition, and hence it is understood that a required thermal expansion difference moving amount can be secured. Therefore, when the actuators are arranged within the outermost diameter of the low-pressure casing end plate 11*a* in the radial direction and perform pulling, it is conceived that the thermal expansion difference adjustment can be performed.

Particularly, when the actuators are arranged at the rigid portions (high-pressure casing) 11*b* and perform pulling, the thermal expansion difference adjustment is facilitated in terms of stress and control accuracy.

Figure 6:
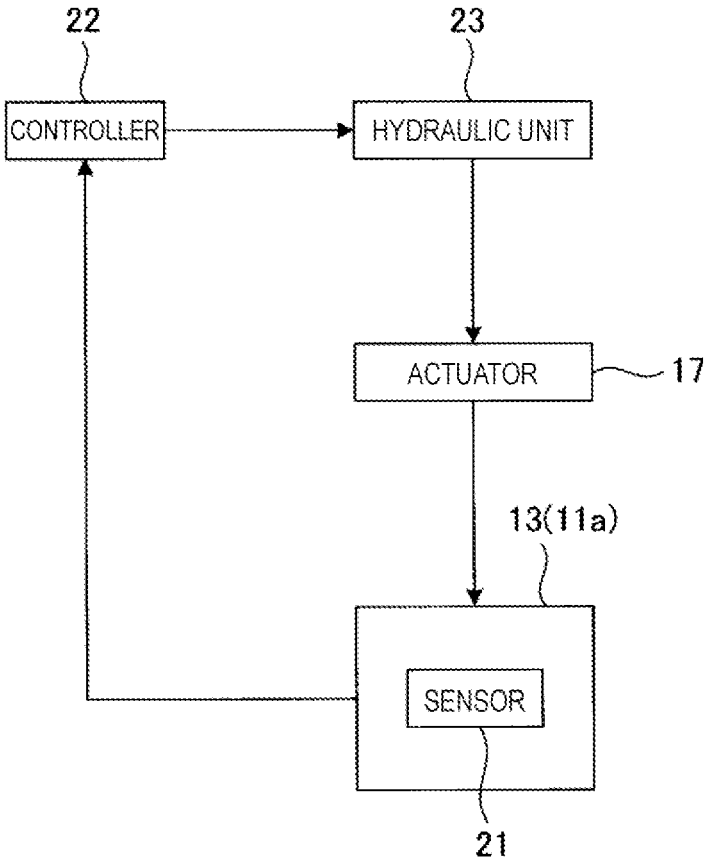
FIG. 6 is a block diagram for illustrating a control system for the actuator in the first embodiment of the present invention.

FIG. 6 is a block diagram for illustrating a control system for the actuator 17 in this embodiment. Note that, description is made of the actuator 17 as a hydraulic cylinder. However, this embodiment is not limited thereto.

In addition to the structure described above, as illustrated in FIG. 6, the casing position adjustment device according to this embodiment includes a sensor 21, a controller 22, and a hydraulic unit 23 in order to control the actuator 17.

As the sensor 21, first, there is used a thermal expansion difference meter (or bearing housing displacement meter) for detecting a detection value for feedback. The thermal expansion difference meter is fixed in the bearing housing 13, and detects a position of the rotor 12 so as to measure a thermal difference between the casing 11 and the rotor 12. Note that, the bearing housing displacement meter is for measuring a displacement amount of the bearing housing 13.

Further, for improvement in reliability, as the sensor 21, it is desired that other sensors be used together with the thermal expansion difference meter (or bearing housing displacement meter). As the other sensors, there may be used a management sensor for monitoring and tripping (shutdown), which performs monitoring, control, or even tripping (shutdown) depending on the situation so that a command value to the actuator 17 is prevented from being an excessively large value. Further, there may be used a comparison evaluation sensor, which makes a comparison between a planned value and a measured value of power generation efficiency and evaluate the resultant.

As the management sensor for monitoring and tripping, for example, there is used one or plurality of sensors among an actuator thrust force meter (load cell) for measuring thrust force of the actuator 17 (force of a load of a hydraulic cylinder), a distortion meter for measuring a distortion (stress) force of the low-pressure casing end plate 11*a*, and an accelerometer for measuring vibration of the low-pressure casing end plate 11*a*.

As the comparison evaluation sensor, for example, there is used one or both of the followings: an axial torque meter for measuring rotation torque of the rotor 12; and an in-casing thermometer for measuring temperature in the casing 11.

The controller 22 controls the actuator 17 through the hydraulic unit 23. First, based on the measured value of the thermal expansion difference obtained by the sensor 21 as the thermal expansion difference meter (or the measured value of the displacement amount of the bearing housing 13 obtained by the sensor 21 as the bearing housing displacement meter), the actuator 17 is controlled so that the thermal expansion difference becomes 0 (or a target value input in advance). Specifically, a control amount of the actuator 17 is calculated, and the actuator 17 is controlled through the hydraulic unit 23 so that the control amount of the actuator 17 becomes the target value (further, when a target control velocity is set, and a displacement velocity is calculated based on the displacement amount of the bearing housing 13, the resultant may be used for controlling the actuator 17).

Further, when the actuator thrust force meter described above is additionally used as the sensor 21, the controller 22 performs monitoring and control of the actuator 17 so that the measured value of the thrust force of the actuator 17 obtained by the sensor 21 as the actuator thrust force meter becomes equal to or less than a predetermined force (first predetermined value).

Further, when the distortion meter described above is additionally used as the sensor 21, in order to monitor strength of the low-pressure casing end plate 11*a*, the controller 22 performs monitoring and control of the actuator 17 so that the measured value of the distortion of the low-pressure casing end plate 11*a* obtained by the sensor 21 as the distortion meter becomes equal to or less than a predetermined distortion (second predetermined value).

Further, when the accelerometer described above is additionally used as the sensor 21, the controller 22 performs monitoring and control of the actuator 17 so that the measured value of the vibration of the low-pressure casing end plate 11*a* obtained by the sensor 21 as the accelerometer becomes equal to or less than a predetermined vibration (third predetermined value).

Further, when the axial torque meter is additionally used as the sensor 21, the controller 22 performs control of the actuator 17 so that, based on the measured value of the axial torque obtained by the sensor 21 as the axial torque meter, a relative position between the casing 11 and the rotor 12 in the rotor axial direction becomes a position enabling the maximum output of the steam turbine. Accordingly, the thermal expansion difference is adjusted.

Further, when the in-casing thermometer is additionally used as the sensor 21, the controller 22 performs control of the actuator 17 so that, based on the measured value of the gas temperature in the casing 11 obtained by the sensor 21 as the in-casing thermometer, the relative position between the casing 11 and the rotor 12 in the rotor axial direction becomes a position enabling the maximum efficiency of the steam turbine. Accordingly, the thermal expansion difference is adjusted.

The casing position adjustment device according to this embodiment includes the configuration as described above. Thus, when the controller 22 performs control of the actuator 17, the low-pressure casing end plate 11*a* extends in the rotor thermal expansion direction, and the thermal expansion difference can be canceled.

Figure 7:
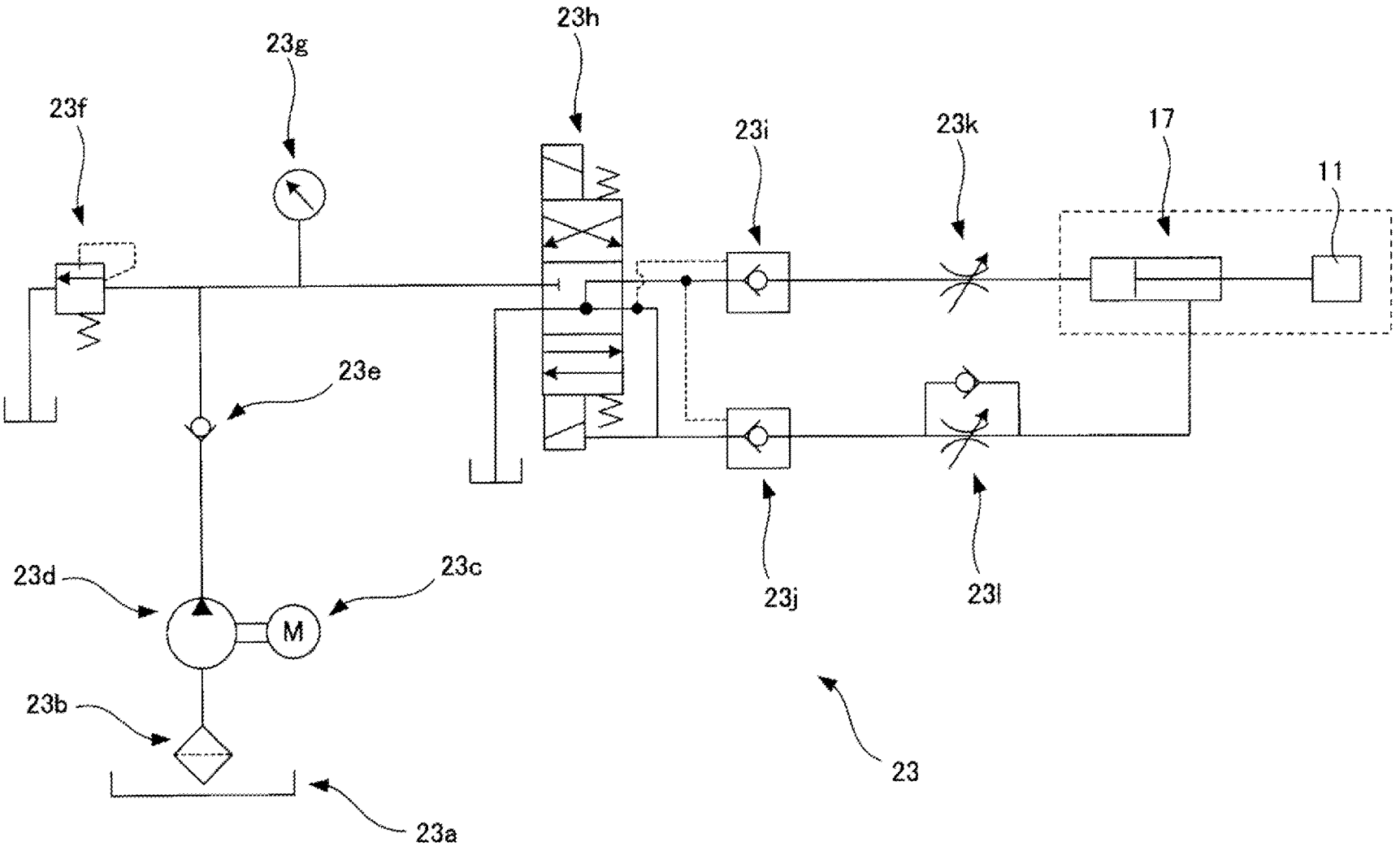
FIG. 7 is a circuit diagram for illustrating a structure of a hydraulic unit to be controlled by a controller in the first embodiment of the present invention.

FIG. 7 is a circuit diagram for illustrating a structure of the hydraulic unit 23 to be controlled by the controller 22. As illustrated in FIG. 7, the hydraulic unit 23 includes a hydraulic tank 23*a*, a filter 23*b*, a motor 23*c*, a hydraulic pump 23*d*, a check valve 23*e*, a relief valve 23*f*, a pressure meter 23*g*, a solenoid valve 23*h*, pilot check valves 23*i* and 23*j*, and velocity regulating throttles 23*k* and 23*l*.

The hydraulic pump 23*d* sucks oil from the hydraulic tank 23*a* through the filter 23*b*, and sends the oil to the fixed side of the hydraulic unit 23. The hydraulic pump 23*d* is operated by the motor 23*c* to which the hydraulic pump 23*d* is connected. Further, on the fixed side of the hydraulic pump 23*d*, the hydraulic pump 23*d* is connected in parallel to the relief valve 23*f* and the solenoid valve 23*h* (through the check valve 23*e*). Further, between the hydraulic pump 23*d* and the solenoid valve 23*h*, the pressure meter 23*g* is provided. Note that, the relief valve 23*f* prevents a hydraulic pressure from increasing and exceeding a set pressure.

The solenoid valve 23*h* switches a flow direction of the oil sent from the hydraulic pump 23*d* between two directions. To one part of the solenoid valve 23*h* on the fixed side, the pilot check valve 23*i* and the velocity regulating throttle 23*k* are provided. To another part of the solenoid valve 23*h* on the fixed side, the pilot check valve 23*j* and the velocity regulating throttle 23*l* are provided.

In a case in which the pump is stopped due to, for example, a power cut, the pilot check valves 23*i* and 23*j* are valves for adjusting the actuator 17 as a hydraulic cylinder to maintain its position.

The velocity regulating throttles 23*k* and 23*l* are provided to the fixed sides of the pilot check valves 23*i* and 23*j*, respectively. The velocity regulating throttle 23*k* is a velocity regulating throttle (meter-in valve) when the casing 11 is pressed by the actuator 17. Further, the velocity regulating throttle 23*k* functions as a velocity regulator when an impact load is applied in a direction of pressing the actuator 17 from the casing 11 side due to, for example, change in pressure in the casing 11. Meanwhile, the velocity regulating throttle 23*l* is a velocity regulating throttle (meter-in valve) when the actuator 17 pulls and positions the casing 11.

That is, in a case in which the actuator 17 is of a hydraulic type (or pneumatic type), the pilot check valves 23*i* and 23*j* are provided so that the thrust force of the actuator 17 is not lost due to, for example, a power cut. The velocity regulating throttles 23*k* and 23*l* are included to regulate operation velocity so that a sudden operation of the actuator 17 is prevented.

Description is given of the casing position adjustment device according to this embodiment above. In the casing position adjustment device according to this embodiment, the thermal expansion difference is subjected to a sensory feedback, and the casing position adjustment is performed. Accordingly, the turbine efficiency can be improved.

Further, in the casing position adjustment device according to this embodiment, when a large thrust load is applied due to, for example, an earthquake, the load can be received by the anchor bolts instead of the actuators. Accordingly, a serious accident such as a blade contact can be avoided.

Further, in the casing position adjustment device according to this embodiment, when the actuator malfunctions, the casing is fixed by the anchor bolts. Accordingly, a serious accident such as a blade contact can be avoided.

Further, in the casing position adjustment device according to this embodiment, the actuators only require thrust force for casing deformation. Thus, small-sized and inexpensive actuators can be employed.

Further, through use of the casing position adjustment device according to this embodiment, the steam turbine can be operated at the maximum output point or the maximum efficiency point.

Second Embodiment

The casing position adjustment device according to a second embodiment of the present invention is obtained by changing mounting positions of the actuators in the casing position adjustment device according to the first embodiment. Description is mainly given of configurations different from those in the first embodiment below. Description for identical configurations are omitted to the extent possible.

Figure 8A:
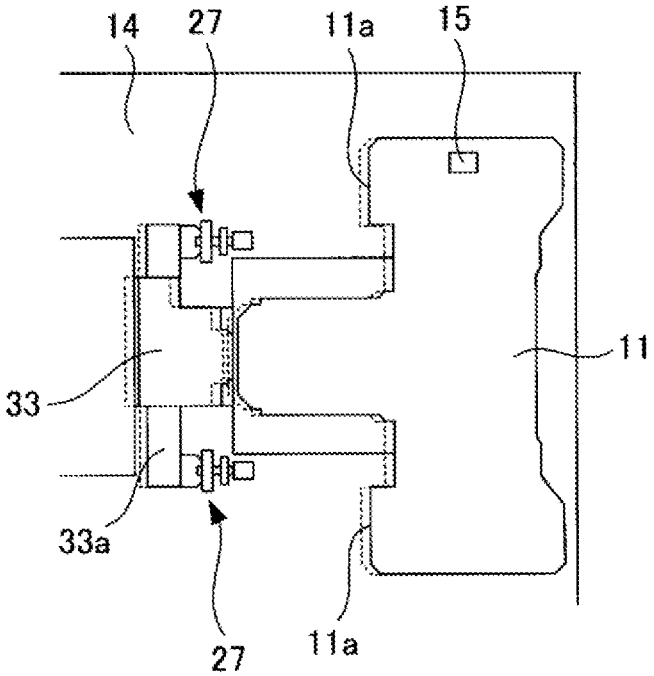
FIGS. 8A to 8C are schematic views for illustrating installation positions of actuators in a second embodiment of the present invention.
Figure 8B:
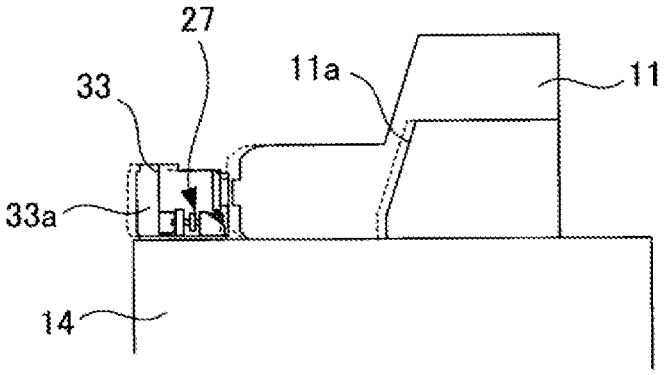
Figure 8C:
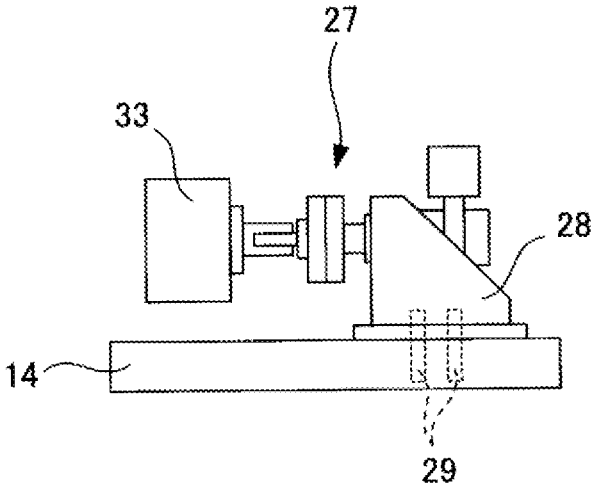

FIGS. 8A to 8C are schematic views for illustrating installation positions of the actuators in this embodiment. FIG. 8A is a top view. FIG. 8B is a side view. FIG. 8C is a partially enlarged view of a portion surrounded by the dashed line of FIG. 8B. Note that, in FIGS. 8A and 8B, illustration of the thrust bearing is omitted.

A bearing housing 33 of the journal bearing included in the casing position adjustment device according to this embodiment is obtained by partially changing the shape of the bearing housing 13. Further, the actuators 27 are connected to the bearing housing 33.

An arm 33*a* is formed to extend in the same direction from each of both side surfaces of the bearing housing 33 in the rotor radial direction and the horizontal direction. The actuators 27 are fixed to the arms 33*a* from the fixed side in the rotor axial direction, and presses the bearing housing 33 in the thermal expansion direction of the rotor 12 (to the free side in the rotor axial direction).

Reaction force receivers 28 are fixed to the base 14 with firm bolts (such as anchor bolts) 29 on the fixed side in the rotor axial direction, and the actuators 27 are fixed to the reaction force receivers 28. Note that, one or a plurality of bolts 29 may be used.

In the casing position adjustment device according to this embodiment, when the thermal expansion difference is caused, the actuators 27 press the bearing housing 33 in the thermal expansion direction of the rotor 12 (to the free side in the rotor axial direction). Then, as indicated by the dashed lines in FIGS. 8A and 8B, the low-pressure casing end plate 11*a* is deformed to extend in the thermal expansion direction of the rotor 12 (to the free side in the rotor axial direction). With this, the casing 11 and the bearing housing 33 are displaced in the rotor heat expansion direction. Accordingly, the heat expansion difference can be canceled.

Note that, the reaction forces of the actuators 27 in this case are received by the reaction force receivers 28. The reaction force receivers 28 are fixed by the bolts 29, and hence are not moved by the reaction forces of the actuators 27.

Note that, when the bearing housing 33 (and the casing 11) is adjusted in the thermal expansion direction, a force of 2838 kN (about 290 tf) is required as sliding friction in the rotor axis direction. When the two actuators 27 press and pull the bearing housing 33 against the friction, each actuator requires thrust force equal to or larger than 1419 kN. In order to obtain the thrust force and achieve a compact design, hydraulic actuators exerting a high pressure of 70 MPa are employed as the actuators 27.

That is, in the casing position adjustment device according to this embodiment, the journal bearing 19 is fixed to the casing 11, and includes the bearing housing 33 having the arms 33*a* respectively extending from both sides in the radial direction and the horizontal direction. The actuators 27 are respectively connected to the arms 33*a* from the fixed side in the axial direction.

Further, the reaction force receivers 28 are respectively fixed to the fixed sides of the arms 33*a* on the base 14, and the actuators 27 are interposed between the reaction force receivers 28 and the arms 33*a*.

In the casing position adjustment device according to this embodiment, the actuators 27 are provided to the bearing housing 33 side, and hence a height from the base at the connection positions are relatively small. Thus, the reaction force receivers 28 can be reduced in size. Further, mounting work or other work can be facilitated.

In the casing position adjustment device according to this embodiment, a surface temperature of the bearing housing 33 is equal to or less than about 60°, and the actuators 27 are connected to the bearing housing 33 through the arms 33*a*. Thus, the actuators 27 having normal temperature can be used.

In the casing position adjustment device according to this embodiment, radial deformation of the bearing housing 33 due to the thermal expansion is negligible, and hence it is not required to mount universal joints to the actuators 27 and connection portions.

Third Embodiment

The casing position adjustment device according to a third embodiment of the present invention is obtained by changing the shape of the reaction force receivers 18 in the casing position adjustment device according to the first embodiment. Description is mainly made of configurations different from those in the first embodiment below. Description for identical configurations are omitted to the extent possible.

Figure 9:
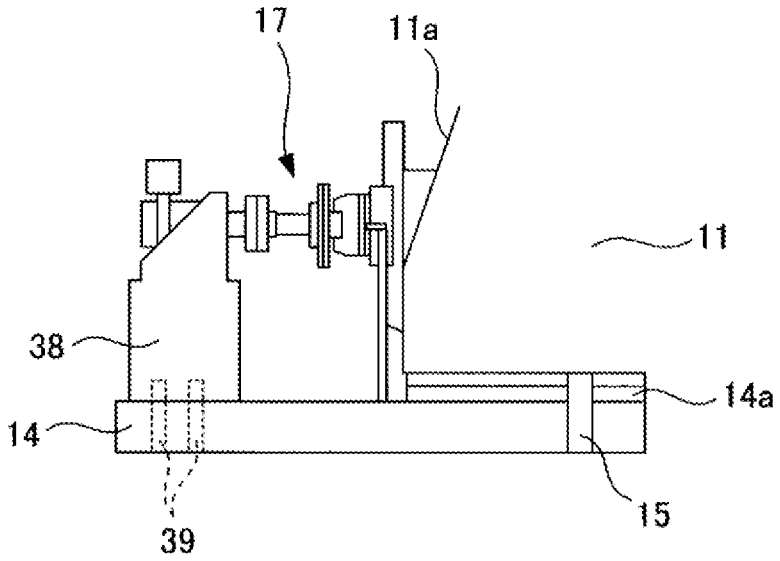
FIG. 9 is a partially enlarged view corresponding to FIG. 4C, for illustrating installation positions of actuators in a third embodiment of the present invention.

FIG. 9 is a partially enlarged view corresponding to FIG. 4C, for illustrating illustration positions of the actuators 17 in this embodiment.

In the casing position adjustment device according to this embodiment, similarly to the first embodiment, the actuators 17 are respectively connected to both the ends of the low-pressure casing end plate 11*a* in the rotor radial direction and the horizontal direction.

The actuators 17 are respectively fixed to the reaction force receivers 38 respectively arranged to both the sides of the low-pressure casing end plate 11*a* in the horizontal direction on the base 14 on the free side. The reaction force receivers 38 are fixed to the base 14 by firm bolts (such as anchor bolts) 39.

That is, in the casing position adjustment device according to this embodiment, the reaction force receivers 38 are respectively fixed to both the ends of the low-pressure casing end plate 11*a* in the radial direction and the horizontal direction on the base 14 on the free side. The actuators 17 are interposed between the reaction force receivers 38 and the low-pressure casing end plate 11*a*.

In the casing position adjustment device according to this embodiment, when the actuators 17 pull the low-pressure casing end plate 11*a*, the low-pressure casing end plate 11*a* is deformed to extend in the thermal expansion direction of the rotor 12 (to the free side in the axial direction). In this case, the reaction forces of the actuators 17 are received by the reaction force receivers 38. The reaction force receivers 38 are fixed by the bolts 39, and hence are not moved by the reaction forces of the actuators 17. In this manner, stress is applied to other parts, and deformation is prevented. Thus, a further high responsibility is achieved.

INDUSTRIAL APPLICABILITY

The present invention is suitable for a casing position adjustment device for a steam turbine to be used in, for example, a power plant.

REFERENCE SIGNS LIST

11 Casing
11A Low-pressure casing
11*a* Low-pressure casing end plate
11B Rib
11*b* Rigid portion (high-pressure casing)
12 Rotor
13, 33 Bearing housing
14 Base
14*a* Base plate
15 Anchor bolt
16 Thrust bearing
17, 27 Actuator
18, 28, 38 Reaction force receiver
21 Sensor
22 Controller
23 Hydraulic unit
23*a* Hydraulic tank
23*b* Filter
23*c* Motor
23*d* Hydraulic pump
23*e* Check valve
23*f* Relief valve
23*g* Pressure meter
23*h* Solenoid valve
23*i*, 23*j* Pilot check valve
23*k*, 23*l* Velocity regulating throttle
29, 39 Bolt
33*a* Arm

The invention claimed is:

1. A casing position adjustment device in a steam turbine including a rotor including a free side end fixed by a journal bearing in a radial direction and a fixed side end fixed by a thrust bearing in an axial direction, and a casing including a fixed side end fixed by the thrust bearing in the axial direction, the casing position adjustment device configured to adjust an axial position of the casing with respect to the rotor due to thermal expansion, the casing position adjustment device comprising:

a low-pressure casing end plate, which is an end plate oriented to a free side in the axial direction in a low-pressure casing of the casing, and has a diaphragm deformable in the axial direction; and actuators, which are configured to deform the low-pressure casing end plate such that the low-pressure casing end plate extends toward the free side in the axial direction.

2. The casing position adjustment device according to claim 1, wherein the casing is fixed by anchor bolts on a fixed side in the axial direction with respect to the low-pressure casing end plate.

3. The casing position adjustment device according to claim 2, wherein the actuators are respectively connected to both ends of the low-pressure end plate in the radial direction and a horizontal direction from the free side in the axial direction.

4. The casing position adjustment device according to claim 3, wherein the casing is fixed on a base through intermediation of a base plate;

reaction force receivers are respectively arranged to both ends of the low-pressure casing end plate in the radial direction and the horizontal direction on the base on the free side;

lower parts of the reaction force receivers extend toward the base plate, and are fixed; and the actuators are interposed between the reaction force receivers and the low-pressure casing end plate.

5. The casing position adjustment device according to claim 3, wherein:

reaction force receivers are respectively fixed to both ends of the low-pressure casing end plate in the radial direction and the horizontal direction on a base on the free side; and the actuators are interposed between the reaction force receivers and the low-pressure casing end plate.

6. The casing position adjustment device according to claim 2, wherein:

the journal bearing is fixed to the casing, and includes a bearing housing having arms respectively extending from both sides of the journal bearing in the radial direction and a horizontal direction; and the actuators are respectively connected to the arms from the fixed side in the axial direction.

7. The casing position adjustment device according to claim 2, further comprising:

a first sensor for measuring a thermal expansion difference which is a difference of a displacement amount of the rotor and a displacement amount of the casing due to thermal expansion; and a controller for controlling the actuators based on a measured value obtained by the first sensor.

8. The casing position adjustment device according to claim 1, wherein the actuators are respectively connected to both ends of the low-pressure end plate in the radial direction and a horizontal direction from the free side in the axial direction.

9. The casing position adjustment device according to claim 8, wherein:

the casing is fixed on a base through intermediation of a base plate;

reaction force receivers are respectively arranged to both ends of the low-pressure casing end plate in the radial direction and the horizontal direction on the base on the free side;

lower parts of the reaction force receivers extend toward the base plate, and are fixed; and the actuators are interposed between the reaction force receivers and the low-pressure casing end plate.

10. The casing position adjustment device according to claim 8, wherein:

reaction force receivers are respectively fixed to both ends of the low-pressure casing end plate in the radial direction and the horizontal direction on a base on the free side; and the actuators are interposed between the reaction force receivers and the low-pressure casing end plate.

11. The casing position adjustment device according to claim 1, wherein:

the journal bearing is fixed to the casing, and includes a bearing housing having arms respectively extending from both sides of the journal bearing in the radial direction and a horizontal direction; and the actuators are respectively connected to the arms from a fixed side in the axial direction.

12. The casing position adjustment device according to claim 11, wherein:

reaction force receivers are respectively fixed to fixed sides of the arms on a base; and the actuators are interposed between the reaction force receivers and the arms.

13. The casing position adjustment device according to claim 1, further comprising:

a first sensor for measuring a thermal expansion difference which is a difference of a displacement amount of the rotor and a displacement amount of the casing due to thermal expansion; and a controller for controlling the actuators based on a measured value obtained by the first sensor.

14. The casing position adjustment device according to claim 13, further comprising a second sensor for measuring thrust force of the actuators, wherein the controller is configured to control the actuators such that a measured value obtained by the second sensor becomes equal to or less than a first predetermined value.

15. The casing position adjustment device according to claim 13, further comprising a third sensor for measuring a distortion force of the low-pressure casing end plate, wherein the controller is configured to control the actuators such that a measured value obtained by the third sensor becomes equal to or less than a second predetermined value.

16. The casing position adjustment device according to claim 13, further comprising a fourth sensor for measuring vibration of the low-pressure casing end plate, wherein the controller is configured to control the actuators such that a measured value obtained by the fourth sensor becomes equal to or less than a third predetermined value.

17. The casing position adjustment device according to claim 13, further comprising a fifth sensor for measuring a rotation torque of the rotor, wherein the controller is configured to control the actuators such that, based on a measured value obtained by the fifth sensor, a relative position between the casing and the rotor in the axial direction becomes a position enabling a maximum output of the steam turbine.

18. The casing position adjustment device according to claim 13, further comprising a sixth sensor for measuring temperature in the casing, wherein the controller is configured to control the actuators such that, based on a measured value obtained by the sixth sensor, a relative position between the casing and the rotor in the axial direction becomes a position enabling a maximum output of the steam turbine.

19. The casing position adjustment device according to claim 1, wherein the actuators are arranged in an outermost diameter of the low-pressure casing end plate in the radial direction.

20. The casing position adjustment device according to claim 1, wherein the low-pressure casing end plate is expanded in the radial direction, and has a shape in which a periphery of a radial outer circumference is inclined in the axial direction.

* * * * *